US009099803B2

(12) United States Patent
Omori et al.

(10) Patent No.: US 9,099,803 B2
(45) Date of Patent: Aug. 4, 2015

(54) JOINT CONNECTOR AND ASSEMBLING METHOD THEREOF

(75) Inventors: Yasuo Omori, Yokkaichi (JP); Hiroki Hirai, Yokkaichi (JP); Masaaki Tabata, Yokkaichi (JP)

(73) Assignees: Autonetworks Technologies, Ltd. (JP); Sumitomo Wiring Systems, Ltd. (JP); Sumitomo Electrical Industries, Ltd. (JP)

( * ) Notice: Subject to any disclaimer, the term of this patent is extended or adjusted under 35 U.S.C. 154(b) by 0 days.

(21) Appl. No.: 14/343,433

(22) PCT Filed: Aug. 27, 2012

(86) PCT No.: PCT/JP2012/005367

§ 371 (c)(1), (2), (4) Date: Mar. 7, 2014

(87) PCT Pub. No.: WO2013/035268

PCT Pub. Date: Mar. 14, 2013

(65) Prior Publication Data

US 2014/0315410 A1 Oct. 23, 2014

(30) Foreign Application Priority Data

Sep. 8, 2011 (JP) ..... 2011-195843

(51) Int. Cl.
*H01R 13/52* (2006.01)
*H01R 31/08* (2006.01)
*H01R 13/639* (2006.01)

(52) U.S. Cl.
CPC ..... *H01R 13/521* (2013.01); *H01R 13/5219* (2013.01); *H01R 13/639* (2013.01); *H01R 31/08* (2013.01)

(58) Field of Classification Search
CPC ..... H01R 13/521; H01R 13/639; H01R 13/5219; H01R 13/4223; H01R 13/11; H01R 31/085; H01R 31/08
USPC ..... 439/271
See application file for complete search history.

(56) References Cited

U.S. PATENT DOCUMENTS 5,201,667 A * 4/1993 Endo et al. ..... 439/189
5,769,650 A 6/1998 Aoyama et al.

(Continued)

FOREIGN PATENT DOCUMENTS

JP 8-250185 9/1996
JP 2005-346940 12/2005

(Continued)

OTHER PUBLICATIONS

International Search Report of Oct. 22, 2012.

*Primary Examiner* — Jean F Duverne
(74) *Attorney, Agent, or Firm* — Gerald E. Hespos; Michael J. Porco; Matthew T. Hespos

(57) ABSTRACT

A joint connector and an assembling method are provided for simultaneously achieving waterproofing and double locking. A ground joint connector (1) includes wire-side terminals (20), a ground terminal (30), a connector housing (40), waterproof plugs (5) and a seal ring (6). The housing (40) includes a wire-side housing (41) and a ground-side housing (42). When the wire-side housing (41) is fixed to the ground-side housing (42) at a first position, locking lances (48) are not restricted at a locking position for locking the wire-side terminal (29) by lance locks (49) in the ground-side housing (42). On the other hand, when the wire-side housing (41) is fixed to the ground-side housing (42) at a second position, the locking lances (48) are restricted at the locking position for locking the wire-side terminals (20) by the lance locks (49).

5 Claims, 12 Drawing Sheets

(56) References Cited

U.S. PATENT DOCUMENTS

| | | | | |
|---|---|---|---|---|
| 6,186,806 | B1 * | 2/2001 | Suzuki et al. | 439/189 |
| 6,786,751 | B2 * | 9/2004 | Maeda et al. | 439/287 |
| 7,118,423 | B2 * | 10/2006 | Kobayashi et al. | 439/682 |
| 7,883,362 | B2 * | 2/2011 | Ichio et al. | 439/511 |
| 8,083,543 | B2 * | 12/2011 | Omori et al. | 439/511 |
| 8,137,116 | B2 | 3/2012 | Omori et al. | |
| 8,182,286 | B2 * | 5/2012 | Tamagawa et al. | 439/587 |
| 8,569,623 | B2 * | 10/2013 | Matsuoka et al. | 174/74 R |

FOREIGN PATENT DOCUMENTS

| | | |
|---|---|---|
| JP | 2011-60522 | 3/2011 |
| JP | 2011-181451 | 9/2011 |

* cited by examiner

JOINT CONNECTOR AND ASSEMBLING METHOD THEREOF

BACKGROUND

1. Field of the Invention

The present invention relates to a joint connector provided in a wiring harness for vehicle and configured to connect various wires such as a plurality of ground wires included in this wiring harness to a predetermined connection section in a vehicle, and an assembling method thereof.

2. Description of the Related Art

Japanese Unexamined Patent Publication No. 2011-60522 discloses a ground joint connector for collectively connecting a plurality of ground wires included in a wiring harness for vehicle to a connection section of a vehicle. This ground joint connector includes a plurality of wire terminals to be mounted on ends of the respective ground wires, a conductor, and a connector housing for holding these wire terminals and conductor. The conductor includes a plurality of wire-side terminal portions to which the respective wire terminals are fitted in a terminal fitting direction, and a ground-side terminal portion to be connected to a ground section in a state fixed on a wall surface of a vehicle body. Each wire-side terminal portion is substantially perpendicular to the terminal fitting direction. Further, the respective wire-side terminal portions are integrally connected to the ground-side terminal portion while being arranged in a direction substantially parallel to the wall surface. A plurality of openings are formed on each of the front and rear surfaces of the connector housing. A plurality of wire-side terminal portions of the conductor are respectively inserted into the front openings. A plurality of wire terminals are inserted into the rear openings. Each wire terminal is fitted to the wire-side terminal portion of the conductor in the connector housing.

In the case of the joint connector as disclosed in the above Japanese Unexamined Patent Publication No. 2011-60522, a plurality of wire terminals mounted on the ends of the respective ground wires are fitted to the wire-side terminal portions of the conductor in the connector housing. In this state, the wire terminals are locked by movable pieces such as locking lances provided in the connector housing and movements of the locking lances are restrained by a retainer. In this way, the wire terminals are doubly locked.

The ground joint connector as described above may be required to have a waterproof function depending on a mounting position. However, in the ground joint connector as described in the above Japanese Unexamined Patent Publication No. 2011-60522, clearances between the front openings and the wire-side terminal portions and those between the rear openings and the wire terminals are exposed to the outside of the connector housing. Thus, such a ground joint connector is not suitable as a waterproof connector.

Contrary to this, the use of a conventional general waterproof connector as a joint connector has problems that the joint connector becomes larger and complicated and manufacturing cost of the joint connector increases.

In addition, in the ground joint connector as described in the above Japanese Unexamined Patent Publication No. 2011-60522, the retainer for doubly locking the wire terminals is provided movably on the outer peripheral surface of the connector housing. This makes it more difficult to waterproof the interior of the connector housing.

In view of such a situation, the present invention aims to provide a joint connector and an assembling method thereof capable of simultaneously achieving waterproofing and double locking.

SUMMARY OF THE INVENTION

To solve the problem, the present invention is directed to a joint connector for connecting a plurality of wires included in a harness to a connection section in a vehicle, including a conductor including a connection-section-side connecting portion shaped to be connectable to the connection section and a plurality of terminal fitting portions; a plurality of wire-side terminals to be respectively connected to ends of the plurality of wires and fitted to the terminal fitting portions; a housing for holding the conductor and the wire-side terminals; waterproof plugs to be respectively mounted on the plurality of wires; and a seal member provided in the housing. The housing includes a wire-side housing portion for holding each wire-side terminal and a conductor-side housing portion for holding the conductor. The wire-side housing portion includes an accommodating portion into which each wire-side terminal is to be accommodated, movable pieces which are provided in the accommodating portion and displaceable between a locking position where the wire-side terminal is locked in the accommodating portion and a retracted position which is retracted from the locking position and where the wire-side terminal is insertable into and withdrawable from the accommodating portion, waterproof plug close-contact portions which communicate with the accommodating portion, into which the wire-side terminals are insertable and which are to be held in close contact with the waterproof plugs, and fitting portion insertion holes which communicate with the accommodating portion and into which the terminal fitting portions are insertable. The conductor-side housing portion includes a cover portion for holding the conductor such that the connection-section-side connecting portion is exposed and covering each terminal fitting portion of the conductor, and movable piece lock portions for restricting the movable pieces at the locking position. The cover portion includes an opening into which the wire-side housing portion is insertable, and the conductor-side housing portion includes a fixing portion for fixing the wire-side housing portion inserted into the opening of the cover portion at a predetermined first position and a second position closer to a back side of the cover portion than the first position. The seal member is provided to seal a clearance between the inner peripheral surface of the cover portion of the conductor-side housing portion and the outer peripheral surface of the wire-side housing portion at least at the second position. The movable piece lock portions are provided at such positions as not to restrict the movable pieces at the locking position when the wire-side housing portion is fixed to the conductor-side housing portion at the first position and, on the other hand, restrict the movable pieces at the locking position when the wire-side housing portion is fixed to the conductor-side housing portion at the second position.

DETAILED DESCRIPTION OF THE PREFERRED EMBODIMENTS

Figure 1:
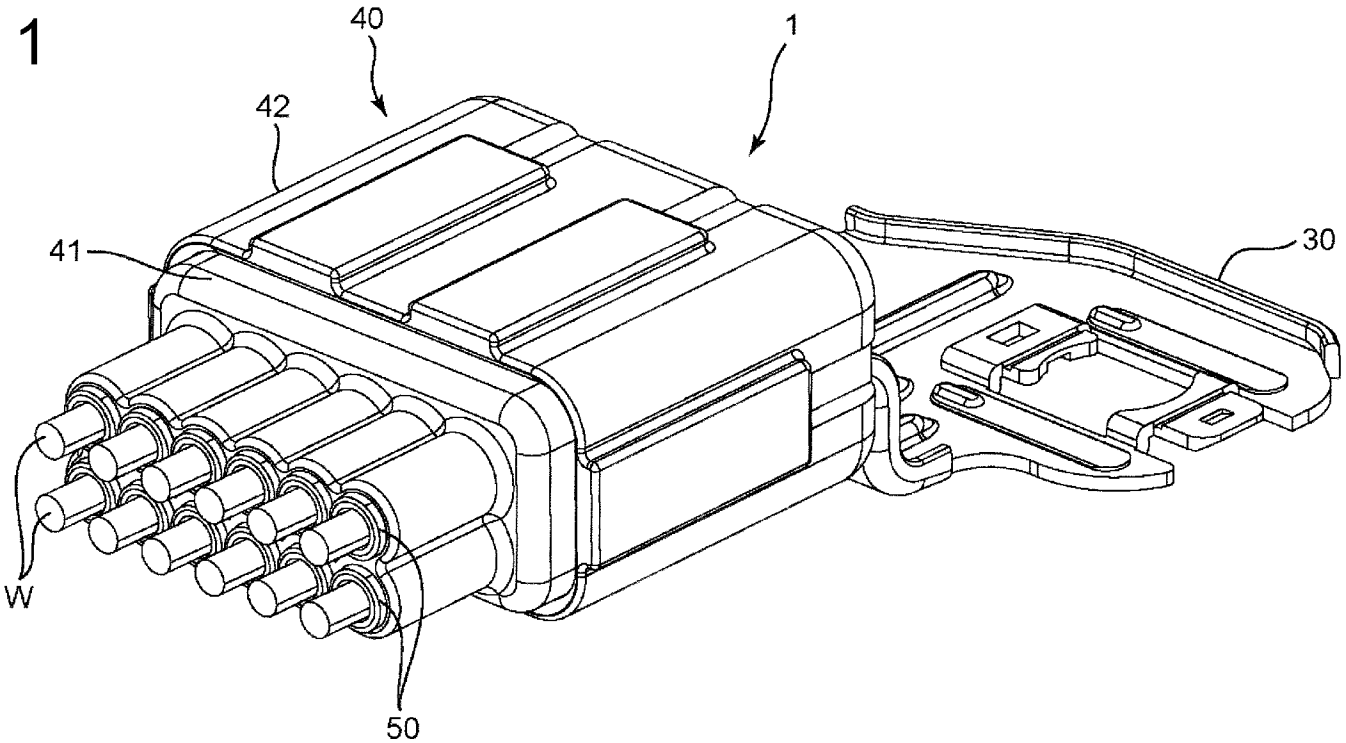
FIG. 1 is a perspective view of a joint connector according to an embodiment of the present invention.

A preferred embodiment of the present invention is described with reference to the drawings.

A ground joint connector 1 shown in FIGS. 1 to 2 and 9 to 12 is a joint connector for connecting a plurality of wires W included in a harness to a ground section such as a bolt disposed in a vehicle, and includes a plurality of wire-side terminals 20, a ground terminal 30, a connector housing 40, waterproof plugs 50 and a seal ring 60.

Figure 2:
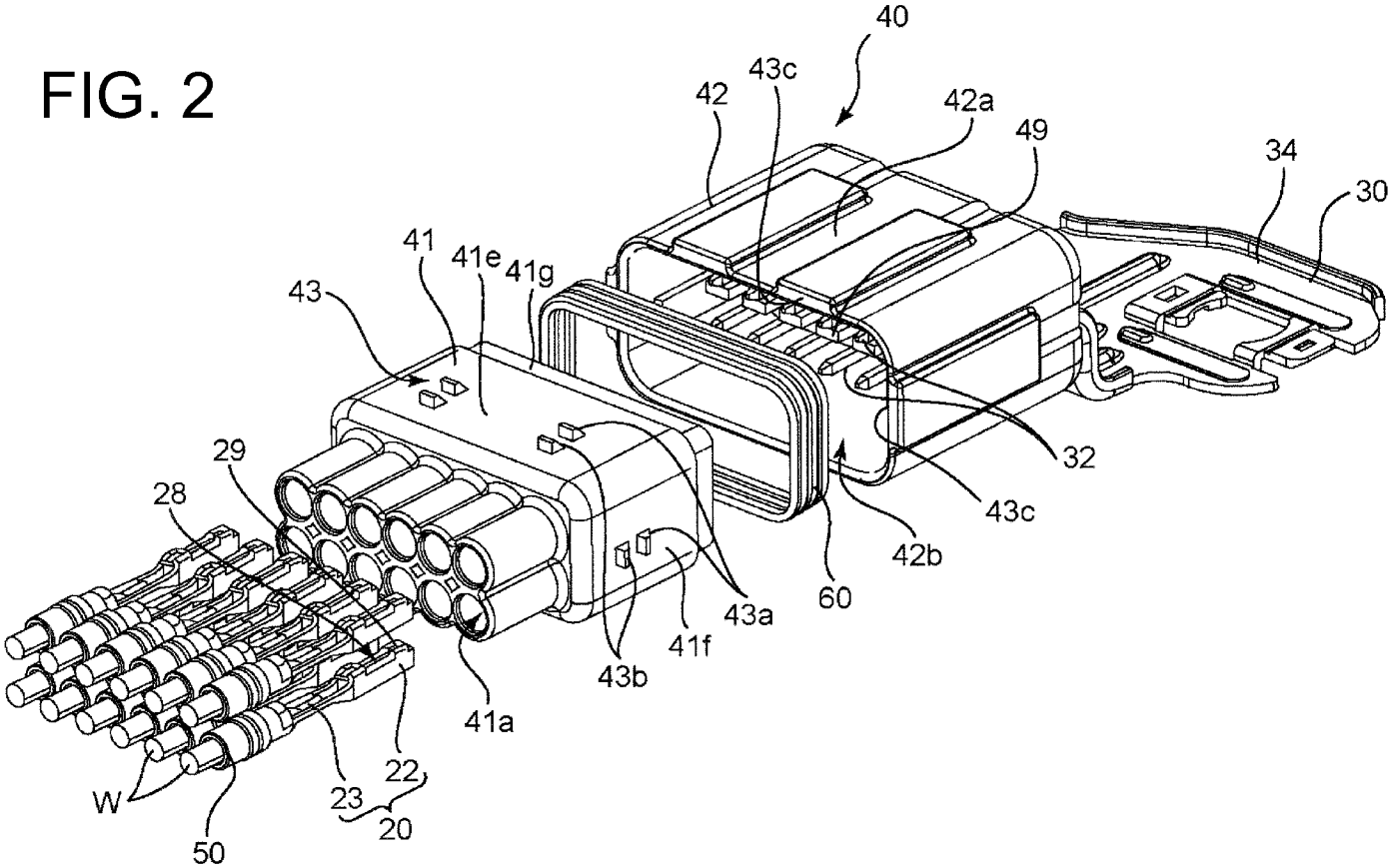
FIG. 2 is an exploded perspective view of the joint connector of FIG. 1.
Figure 10:
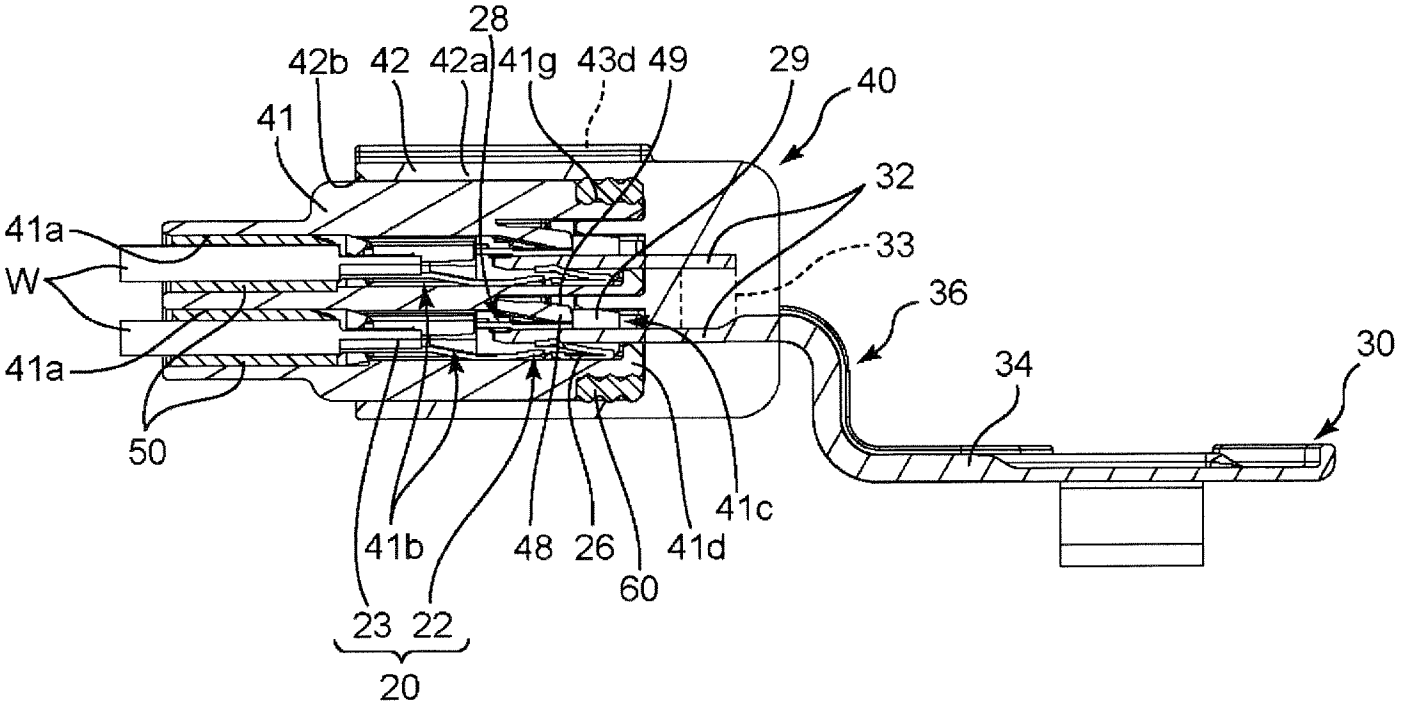
FIG. 10 is a section along X-X of FIG. 9.

As shown in FIGS. 2 and 10, the plurality of wire-side terminals 20 are respectively connected to ends of the wires W. Each wire-side terminal 20 includes a female electric contact portion 22 and a conductor barrel 23. These electric contact portion 22 and conductor barrel 23 are arranged one after the other in a front-back direction of the wire-side terminal 20.

The female electric contact portion 22 is shaped to be fittable to a terminal fitting portion 32 of the ground terminal 30. Specifically, the electric contact portion 22 includes a main body in the form of a hollow rectangular tube and a contact spring piece 26 deflectably provided in this main body. A lance insertion hole 28 into which a locking lance 48 (see FIG. 10) to be described later is to be inserted is formed in the ceiling wall of this electric contact portion 22.

The conductor barrel 23 is integrally formed of a metal material such as copper or aluminum together with the electric contact portion 22. The conductor barrel 23 is crimped to a conductor part exposed to the outside by removing an insulation coating of an end part of the wire W. The conductor barrel 23 is wound around and fastened to the conductor part.

Figure 3:
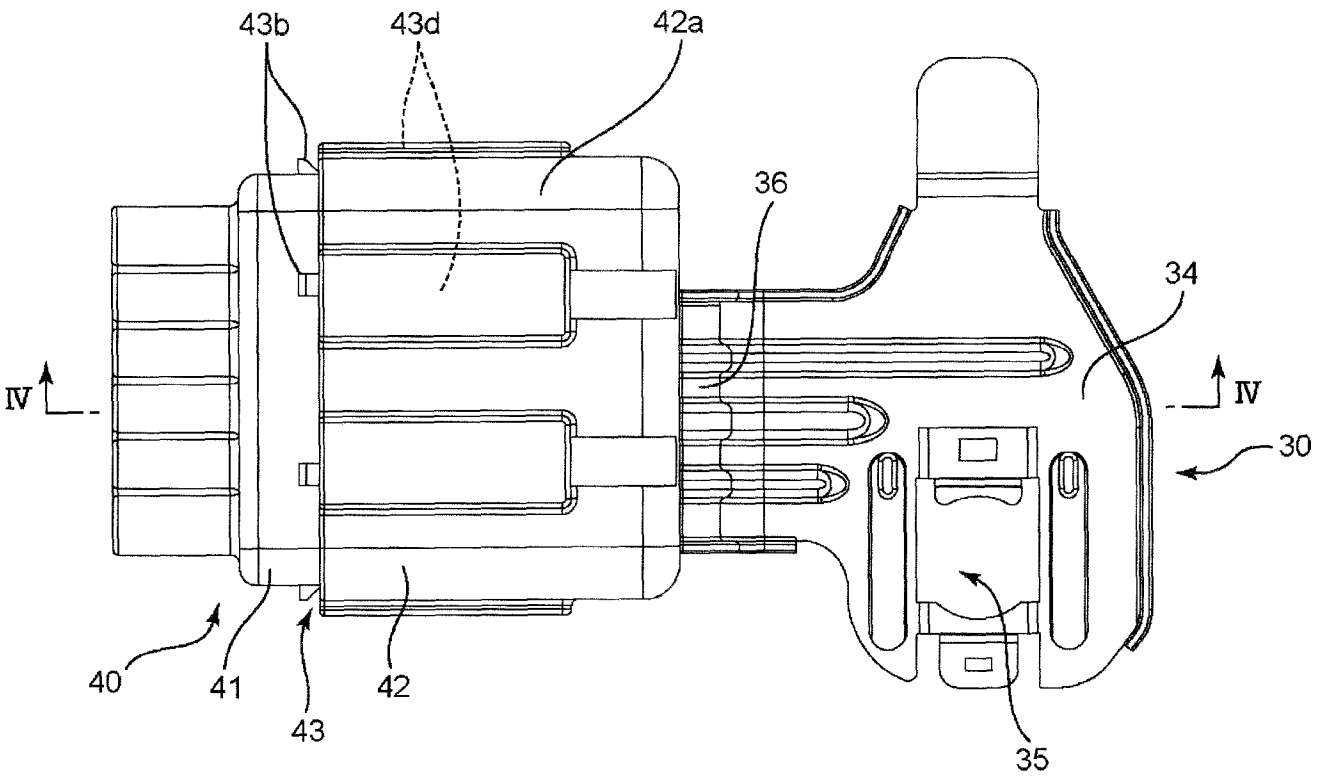
FIG. 3 is a plan view showing a housing and a conductor in a state where a wire-side housing portion is at a first position before wire-side terminals of ground wires are connected to the wire-side housing portion to explain an assembling method of the joint connector of FIG. 1.
Figure 4:
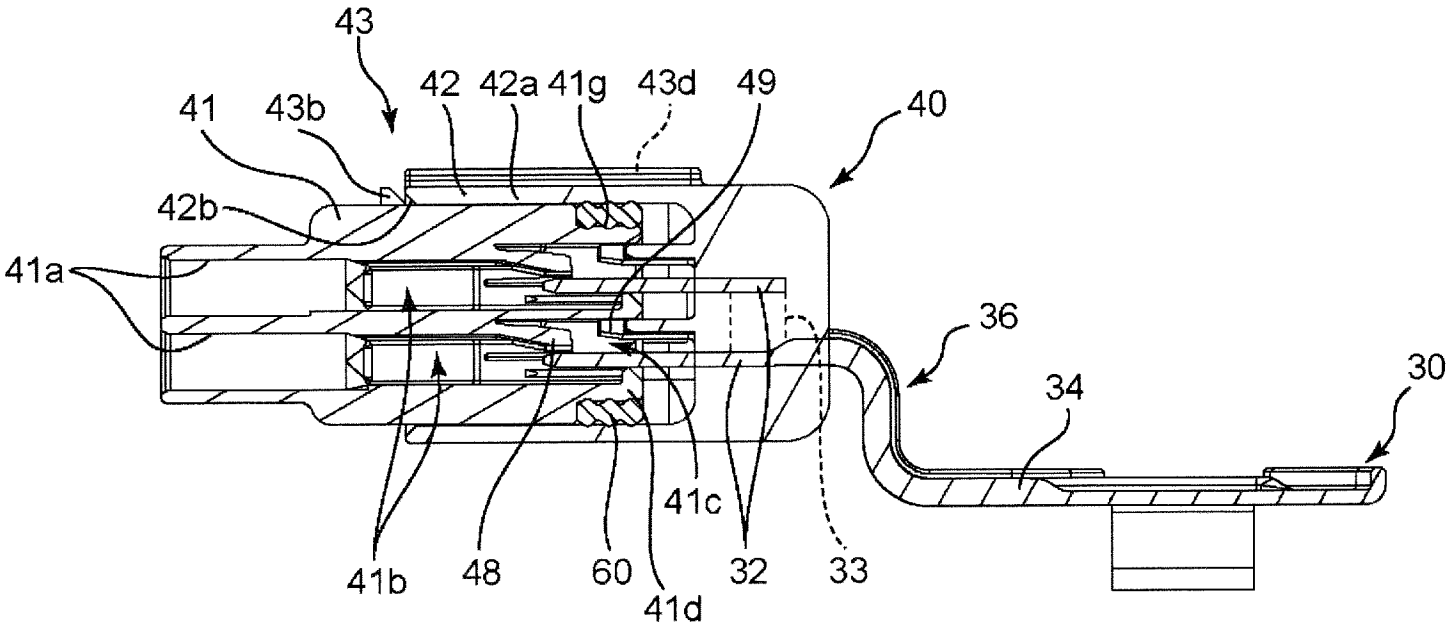
FIG. 4 is a section along IV-IV of FIG. 3.

The ground terminal 30 is a member made of a conductive material and configured to collectively connect, i.e. ground the wire-side terminals 20 to the ground section by being commonly connected to the respective wire-side terminals 20. As shown in FIGS. 2 to 4, the ground terminal 30 includes a plurality of (twelve in a shown example) terminal fitting portions 32, a coupling portion 33 for coupling end parts of the respective terminal fitting portions 32 to each other, a ground connection portion 34 and a step portion 36 interposed between the coupling portion 34 and the ground connection portion 34. The above terminal fitting portions 32, coupling portion 33, ground connection portion 34 and step portion 36 are integrally formed. Here, the ground terminal 30 corresponds to a conductor of the present invention and the ground connection portion 34 corresponds to a connection-section-side connecting portion of the present invention. Each terminal fitting portion 32 is electrically connected to the common ground connection portion 34 via the coupling portion 33 and the step portion 36. Six of the plurality of terminal fitting portions 32 are arranged in each of two upper and lower rows.

Each terminal fitting portion 32 is formed by a male tab (i.e. tab terminal) projecting backward (toward the wire W) of the ground joint connector 1 and fittable into the female electric contact portion 22 of the wire-side terminal 20 in a predetermined terminal fitting direction. Each terminal fitting portion 32 is electrically connected to the female electric contact portion 22 by coming into contact with the inner peripheral surface of the electric contact portion 22 and the contact spring piece 26.

The step portion 36 enables each terminal fitting portion 32 and the ground connection portion 34 to be electrically connected while providing a predetermined level difference between the lower surface of the connector housing 40 and the ground connection portion 34.

The ground connection portion 34 is a plate-like part including a through hole 35. The ground connection portion 34 can be fixed to a wall surface in the vehicle in a state connected to the ground section such as a bolt. The ground connection portion 34 corresponds to a connection-section-side terminal portion of the present invention.

As shown in FIGS. 2 to 4, the connector housing 40 holds the ground terminal 30 and the wire-side terminals 20. The connector housing 40 includes a wire-side housing portion 41 for holding the respective wire-side terminals 20, a ground-side housing portion 42 for holding the ground terminal 30 and a coupling portion 43 for coupling the wire-side housing portion 41 and the ground-side housing portion 42 to each other.

The wire-side housing portion 41 includes terminal insertion holes 41*a*, an accommodating portion 41*b* and fitting portion insertion holes 41*c*. The respective wire-side terminals 20 are insertable into the terminal insertion holes 41*a*. The waterproof plug 50 can be held in close contact with the terminal insertion hole 41*a*. The accommodating portion 41*b* communicates with the terminal insertion holes 41*a*. The wire-side terminals 20 are accommodated in the accommodating portion 41*b*. The fitting portion insertion holes 41*c* communicate with the accommodating portion 41*b*. The terminal fitting portions 32 are insertable into the fitting portion insertion holes 41*c*. The wire-side terminal 20 is inserted into the accommodating portion 41*b* through the terminal insertion hole 41*a*. The inserted wire-side terminal 20 comes into contact with a projection 41*d* to be positioned at a predetermined position in the accommodating portion 41*b*.

The terminal insertion hole 41*a* corresponds to a waterproof plug close contact portion. The terminal insertion hole 41*a* communicates with the accommodating portion 41*b*. The wire-side terminal 20 is insertable into the terminal insertion hole 41*a*. The inner peripheral surface of the terminal insertion hole 41*a* is held in close contact with the waterproof plug 50.

Further, the locking lance 48 (movable piece) is vertically pivotally provided in the accommodating portion 41*b* of the wire-side housing portion 41. As shown in FIG. 4, the locking lance 48 can be displaced between a locking position and a retracted position. The locking position is a position where the locking lance 48 locks the wire-side terminal 20 in the accommodating portion 41*b*. The retracted position is a position where the locking lance 48 is retracted upward from the locking position and the wire-side terminal 20 is insertable into and withdrawable from the accommodating portion 41*b*. As shown in FIG. 10, at the locking position, the locking lance 48 is fitted into the lance insertion hole 28 of the female electric contact portion 22 in a state projecting into the accommodating portion 41*b*, thereby being able to lock the wire-side terminal 20 in the accommodating portion 41*b*. On the other hand, at the retracted position, the locking lance 48 is retracted upward from the female electric contact portion 22 and not fitted in the lance insertion hole 28, wherefore the wire-side terminal 20 can be inserted into and withdrawn from the accommodating portion 41*b*.

The ground-side housing portion 42 includes a cover portion 42*a* and lance locking portions 49 for restricting the locking lance 48 at the locking position (see FIG. 10). The cover portion 42*a* holds the ground terminal 30 in such a manner as to expose the ground connection portion 34 of the ground terminal 30 and covers each terminal fitting portion 32 of the ground terminal 30. The cover portion 42*a* includes an opening 42*b* into which the wire-side housing portion 41 is insertable. Here, the ground-side housing portion 42 corresponds to a conductor-side housing portion of the present invention.

The lance locking portion 49 is provided at such a position as not to restrict the locking lance 48 at the locking position when the wire-side housing portion 41 is fixed to the ground-side housing portion 42 at the first position (see FIGS. 4 and 8) and, on the other hand, restrict the locking lance 48 at the locking position when the wire-side housing portion 41 is fixed to the ground-side housing portion 42 at the second position (see FIG. 10). In this embodiment, the lance locking portion 49 is provided at such a position as to be located at a side of the locking lance 48 opposite to the wire-side terminal 20 and restrict the locking lance 48 at the locking position (see FIG. 10) when the wire-side housing portion 41 is fixed to the ground-side housing portion 42 at the second position (see FIG. 10).

Specifically, the lance locking portion 49 is provided at such a position as to come into contact with the upper surface of the corresponding locking lance 48 of the wire-side housing portion 41 inserted into the opening 42*b* on a back side of the cover portion 42*a*. This enables the lance locking portion 49 to press the locking lance 48 downward and restrict the locking lance 48 in a state facing obliquely downward in the accommodating portion 41*b* of the wire-side housing portion 41 when the wire-side housing portion 41 is located at the second position (FIG. 10).

The ground-side housing portion 42 is insert-molded in a state where the terminal fitting portions 32 of the ground terminal 30 are projecting in the cover portion 42*a*.

The coupling portion 43 can fix the wire-side housing portion 41 in two steps in a state inserted in the opening 42*b* of the cover portion 42*a* of the ground-side housing portion 42, i.e. can be fixed at a predetermined first position (see FIGS. 3 to 8) and a second position (see FIGS. 9 to 12) closer to the back side of the cover portion 42*a* than the first position.

As shown in FIGS. 2 to 6, the coupling portion 43 includes first projections 43*a*, second projections 43*b*, fixing portions 43*c* and projection accommodating portions 43*d*. The first and second projections 43*a*, 43*b* are provided on the wire-side housing portion 41. The fixing portions 43*c* and the projection accommodating portions 43*d* are provided on the cover portion 42*a* of the ground-side housing portion 42.

Specifically, the first projections 43*a* are provided to project from an upper surface 41*e* and opposite side surfaces 41*f* of the wire-side housing portion 41. The first projections 43*a* are arranged at such positions engageable with the fixing portions 43*c* when the wire-side housing portion 41 is located at the first position (see FIGS. 3 to 6). The first projection 43*a* is formed with an inclined surface 43*a*1 (see FIG. 5) facing toward the fixing portion 43*c* so as to be easily engageable with the fixing portion 43*c* when the wire-side housing portion 41 is inserted to the first position in the opening 42*b* of the cover portion 42*a* of the ground-side housing portion 42.

Similarly to the first projections 43*a*, the second projections 43*a* are provided to project from the upper surface 41*e* and the opposite side surfaces 41*f* of the wire-side housing portion 41. The second projections 43*b* are arranged at such positions engageable with the fixing portions 43*c* when the wire-side housing portion 41 is located at the second position (see FIGS. 9 and 10). These second projections 43*b* are arranged at positions closer to the terminal insertion holes 41*a* than the first projections 43*a* so as to be inserted into the opening 42*b* of the cover portion 42*a* later than the first projections 43*a*. The first and second projections 43*a*, 43*b* are arranged one after the other along an inserting direction of the wire-side housing portion 41 into the opening 42*b*. Furthermore, similarly to the first projection 43*a*, the second projection 43*b* is formed with an inclined surface 43*b*1 (see FIG. 5) facing toward the fixing portion 43*c* so as to be easily engageable with the fixing portion 43*c* when the wire-side housing portion 41 is inserted to the second position in the opening 42*b* of the cover portion 42*a* of the ground-side housing portion 42.

The fixing portions 43*c* are rib-like parts provided at positions engageable with the respective first and second projections 43*a*, 43*b* along the inner peripheral edge of the opening 42*b* of the cover portion 42*a* of the ground-side housing portion 42. The fixing portions 43*c* fix the wire-side housing portion 41 inserted into the opening 42*b* of the cover portion 42*a* of the ground-side housing portion 42 at the predetermined first position (see FIGS. 3 to 8) and the second position (see FIGS. 9 to 12) closer to the back side of the cover portion 42*a* than the first position by being engaged with the first and second projections 43*a*, 43*b*.

The projection accommodating portions 43*d* are formed to protrude outward at positions adjacent to the fixing portions 43*c* and more distant from the opening 42*b* than the fixing portions 43*c* on the upper and side surfaces of the cover portion 42*a* of the ground-side housing portion 42. End parts of the projection accommodating portions 43*d* close to the inner peripheral edge of the opening 42*b* are closed by the fixing portions 43*c*.

Figure 5:
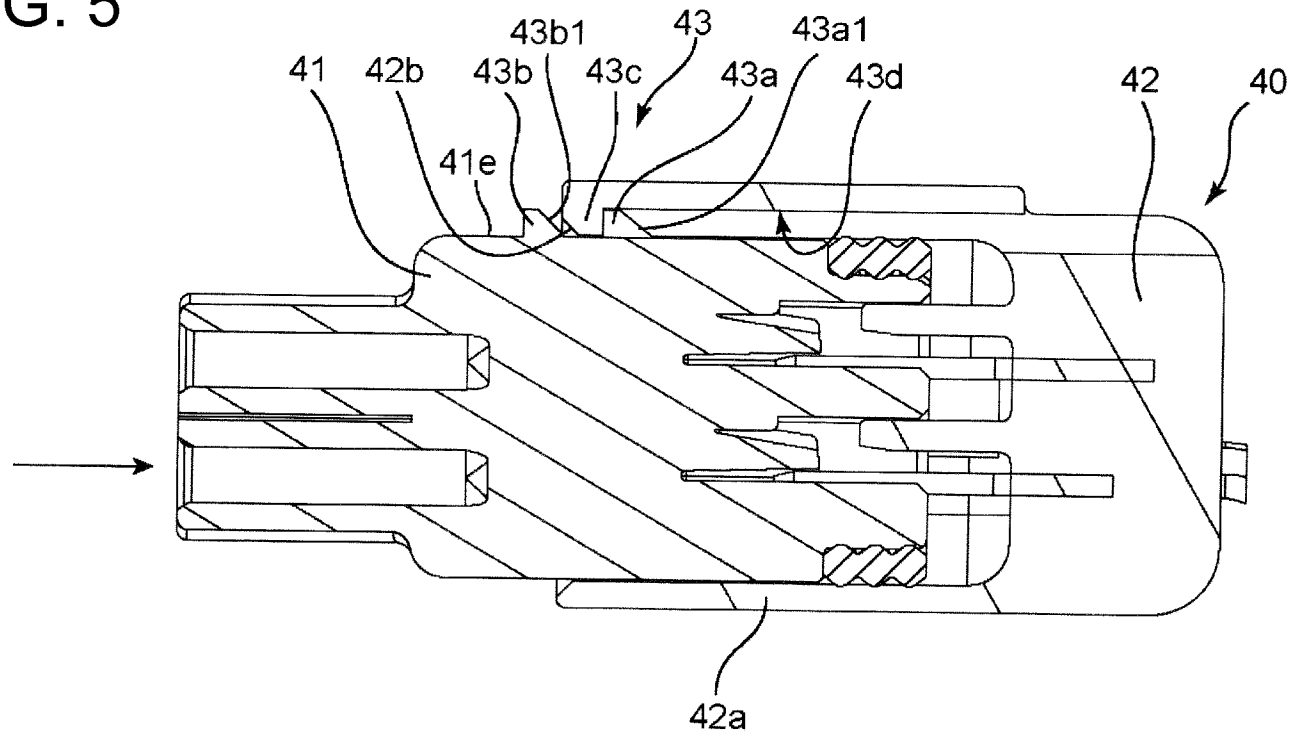
FIG. 5 is a vertical section of a casing of FIG. 3 cut in a vertical direction at the position of a coupling portion on an upper surface.
Figure 6:
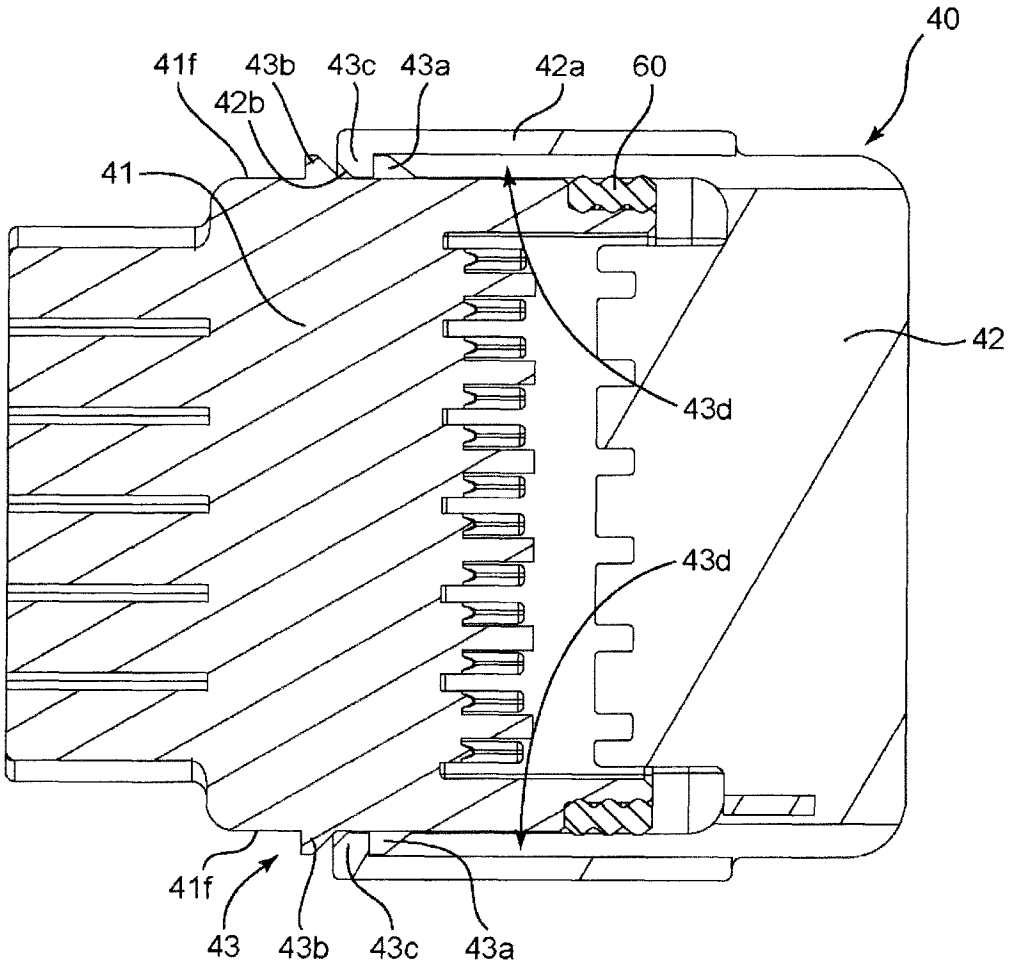
FIG. 6 is a horizontal section of the casing of FIG. 3 cut in a horizontal direction at the positions of the coupling portion on both side surfaces.

When the wire-side housing portion 41 is inserted to the first position in the opening 42*b* of the cover portion 42*a* of the ground-side housing portion 42, the first projections 43*a* are engaged with the fixing portions 43*c* in a state accommodated in the projection accommodating portions 43*d* (see FIGS. 5 and 6). When the wire-side housing portion 41 is inserted to the second position, the second projections 43*b* are engaged with the fixing portions 43*c* in a state accommodated in the projection accommodating portions 43*d* (see FIGS. 11 and 12).

The waterproof plug 50 is a cylindrical packing to be fitted onto each wire W. The waterproof plug 50 comes into close contact with the inner peripheral surface of the terminal insertion hole 41*a* when the wire W is inserted into the terminal insertion hole 41*a* of the wire-side housing portion 41. The waterproof plug 50 is manufactured of a flexible material with high adhesion such as urethane rubber and butyl rubber.

The seal ring 60 seals between the inner peripheral surface of the cover portion 42*a* of the ground-side housing portion 42 and the outer peripheral surface of the wire-side housing portion 41. The seal ring 60 corresponds to a seal member provided in the housing 40 of the present invention. The seal ring 60 is fitted into a groove portion 41*g* formed on the outer peripheral surface of a tip part of the wire-side housing portion 41 and, in that state, inserted to the back of the cover portion 42*a* of the ground-side housing portion 42 together with the wire-side housing portion 41, thereby being able to seal a clearance between the cover portion 42*a* of the ground-side housing portion 42 and the wire-side housing portion 41. Note that the seal ring 60 only has to be so provided as to seal the clearance between the inner peripheral surface of the cover portion 42*a* of the ground-side housing portion 42 and the outer peripheral surface of the wire-side housing portion 41 at least at the second position (see FIG. 10).

In the ground joint connector 1 configured as described above, the locking lances 48 are not restricted at the locking position by the lance locking portions 49 when the wire-side housing portion 41 is fixed to the ground-side housing portion 42 at the first position (see FIGS. 7 and 8) by the coupling portion 43 (specifically, the first projections 43*a* and the fixing portions 43*c* engaged therewith). In this state, the wire-side terminals 20 accommodated in the accommodating portion 41*b* are locked by the locking lances 48, but held in a so-called temporarily held (i.e. provisionally held) state since the locking lances 48 are not restricted.

On the other hand, when the wire-side housing portion 41 is fixed to the ground-side housing portion 42 at the second position (see FIGS. 9 and 10) by the coupling portion 43 (specifically, the second projections 43*b* and the fixing portions 43*c* engaged therewith), the locking lances 48 are restricted at the locking position by the lance locking portions 49 and the wire-side terminals 20 are fully locked (i.e. constantly locked). By this, whether or not the wire-side terminals 20 in the connector housing 40 are fully locked (i.e. doubly locked by the locking lances 48 and the lance locking portions 49) can be easily confirmed if the position of the wire-side housing portion 41 is seen from the outside.

Further, as shown in FIGS. 2 and 10, the wire-side terminal 20 of this embodiment includes a lance displacing portion 29 for displacing the locking lance 48 from the locking position where the locking lance 48 locks the wire-side terminal 20 in the accommodating portion 41*b* to the retracted position. The lance displacing portion 29 is provided at such a position as to be able to displace the locking lance 48 to the retracted position and bring the locking lance 48 into contact with the lance locking portion 49 so that the locking lance prohibits a shift of the wire-side housing portion 41 from the first position (see FIG. 8) to the second position (see FIG. 10) while the wire-side terminal 20 is being accommodated into the accommodating portion 41*b* of the wire-side housing portion 41.

Next, an assembling method of the ground joint connector 1 of this embodiment is described with reference to the drawings.

First, the connector housing 40, the wire-side terminals 20 and the waterproof plugs 50 of the ground joint connector 1 of this embodiment are prepared (preparation step).

Subsequently, as shown in FIGS. 7 to 10, the wire-side terminals 20 are inserted through the terminal insertion holes 41*a* to be accommodated into the accommodating portion 41*a* and the waterproof plugs 50 are brought into close contact with the inner peripheral surfaces of the terminal insertion holes 41*a* with the wire-side housing portion 41 fixed to the ground-side housing portion 42 at the first position by the engagement of the first projections 43*a* and the fixing portions 43*c* of the coupling portion 43. At this time, the locking lances 48 are fitted into the lance insertion holes 28 of the female electric contact portions 22 of the wire-side terminals 20 in a state where the locking lances 48 are projecting into the accommodating portion 41*b*, whereby the wire-side terminals 20 are held in the accommodating portion 41*b* (temporary holding step).

Although the locking lances 48 project into the accommodating portion 41*b* and lock the wire-side terminals 20 during this temporary holding, they are displaceable between the locking position and the retracted position without being restricted at the locking position by the lance locking portions 49. Accordingly, a locked state by the locking lances 48 is weaker than in the fully locked state to be described later. Thus, the wire-side terminals 20 can be easily inserted into such a wire-side housing portion 41 fixed at the first position with a weak force.

Thereafter, as shown in FIGS. 9 to 12, the wire-side housing portion 41 is moved toward the back of the cover portion 42*a* and fixed to the ground-side housing portion 42 at the second position by the engagement of the second projections 43*b* and the fixing portions 43*c* of the coupling portion 43. In that state, the locking lances 48 are restricted at the locking position for locking the wire-side terminal 20 in the accommodating portion 41*b* by the lance locking portions 49. This causes the wire-side terminals 20 to be restricted in the accommodating portion 41*b* (full locking step). As a result, the wire-side terminals 20 are doubly locked by the locking lances 48 and the lance locking portions 49 and it is difficult to withdraw the wire-side terminals 20 from the wire-side housing portion 41.

Furthermore, if the ground connection portion 34 is connected to the predetermined ground section in the vehicle by a bolt or the like after the full locking step, a series of processes up to ground connection are completed (ground connection step).

In the ground joint connector 1 of this embodiment, the connector housing 40 includes the ground-side housing portion 42 and the wire-side housing portion 41. The wire-side housing portion 41 is coupled to the ground-side housing portion 42 at two positions by the coupling portion 43, whereby the wire-side terminals 20 can be reliably temporarily held and fully locked.

Specifically, the locking lances 48 for locking the wire-side terminals 20 are provided in the accommodating portion 41*b* into which the wire-side terminals 20 are to be accommodated. These locking lances 48 are displaceable between the locking position where the wire-side terminal 20 is locked in the accommodating portion 41*b* and the retracted position which is retracted from the locking position and where the wire-side terminal 20 is insertable into and withdrawable from the accommodating portion 41*b*. For example, when the wire-side housing portion 41 is fixed to the ground-side housing portion 42 at the first position by the coupling portion 43 (specifically, the first projections 43*a* and the fixing portions 43*c* engaged therewith shown in FIG. 6) as shown in FIGS. 7 and 8, the locking lances 48 are not restricted at the locking position by the lance locking portions 49 and the wire-side terminals 20 are temporarily held.

Figure 11:
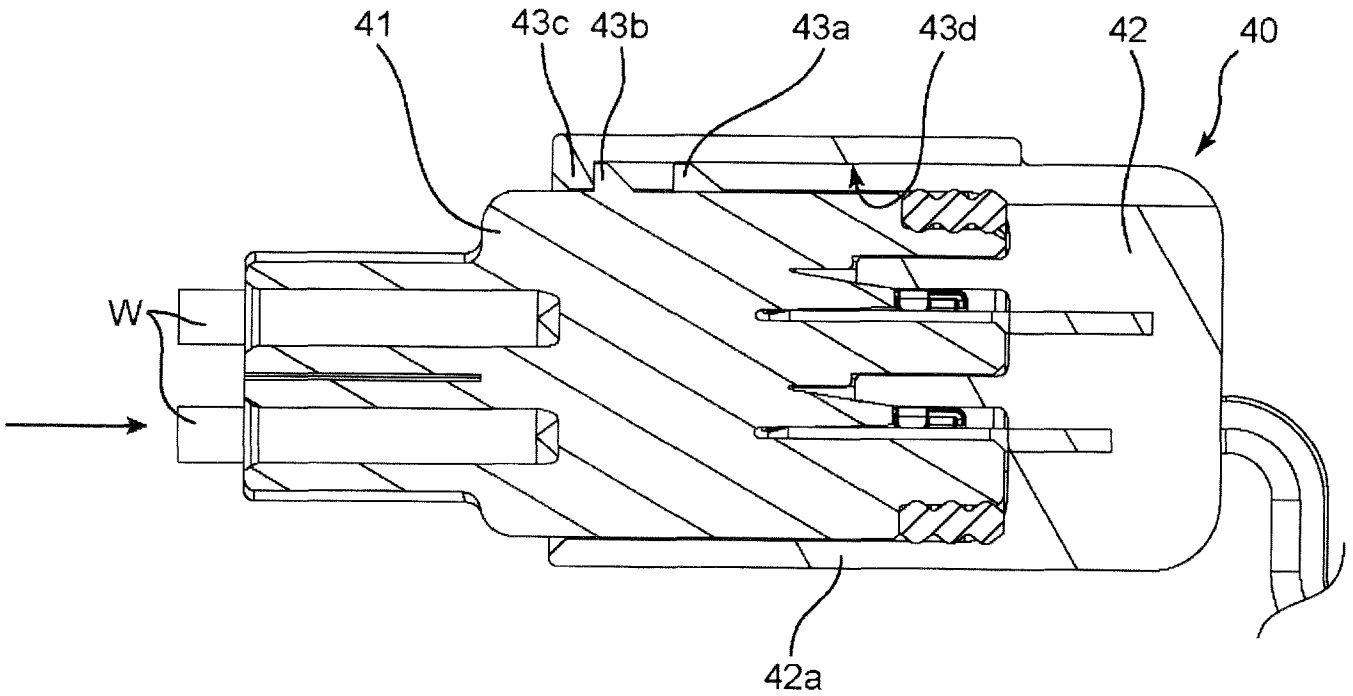
FIG. 11 is a vertical section of the casing of FIG. 9 cut in the vertical direction at the position of the coupling portion on the upper surface.
Figure 12:
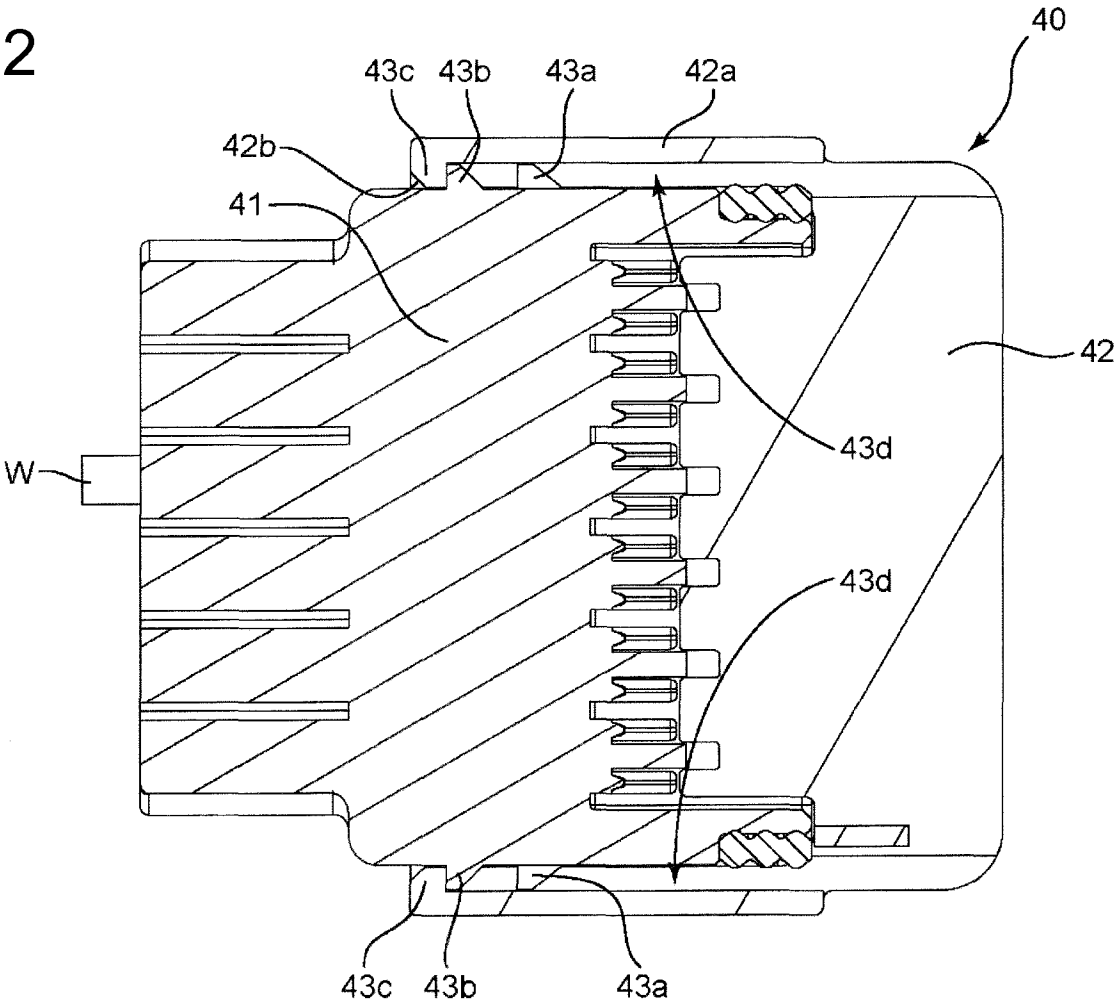
FIG. 12 is a horizontal section of the casing of FIG. 3 cut in the horizontal direction at the positions of the coupling portion on the both side surfaces.

On the other hand, when the wire-side housing portion 41 is fixed to the ground-side housing portion 42 at the second position by the coupling portion 43 (specifically, the second projections 43*b* and the fixing portions 43*c* engaged therewith shown in FIG. 11) as shown in FIGS. 9 to 12, the locking lances 48 are restricted at the locking position by the lance locking portions 49. As a result, the wire-side terminals 20 are locked in the accommodating portion 41*b* by being doubly locked by the locking lances 48 and the lance locking portions 49, thereby being fully locked. By this, whether or not the wire-side terminals 20 in the housing are doubly locked can be easily confirmed by confirming from the outside whether or not the wire-side housing portion 41 is at the second position.

In addition, since the wire-side terminals 20 are doubly locked in the connector housing 40 by coupling the two housing portions 41, 42, a member such as a retainer for double locking is not exposed to the outside of the connector housing 40, the waterproof plugs 50 are held in close contact with the inner peripheral surfaces of the terminal insertion holes 41*a* (waterproof plug close contact portions) of the wire-side housing portions 41 to provide sealing and the seal ring 60 seals the clearance between the inner peripheral surface of the cover portion 42*a* of the ground-side housing portion 42 and the outer peripheral surface of the wire-side housing portion 41. Thus, the waterproof function of the connector housing 40 can be maintained. This enables the waterproofing of the joint connector and double locking to be simultaneously achieved.

Figure 7:
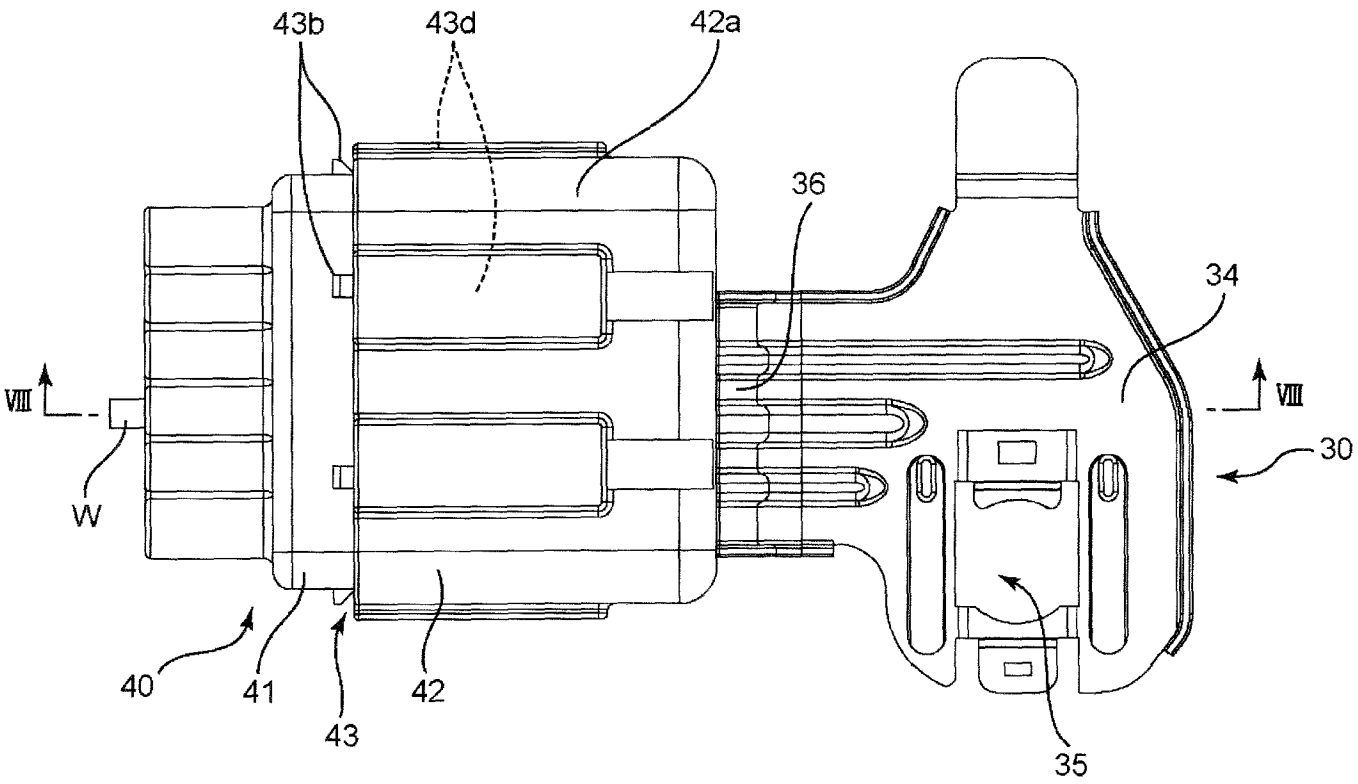
FIG. 7 is a plan view of the joint connector of FIG. 3 showing a state where the wire-side housing portion is at the first position and the wire-side terminals of the ground wires are connected to the wire-side housing portion to be temporarily held.
Figure 8:
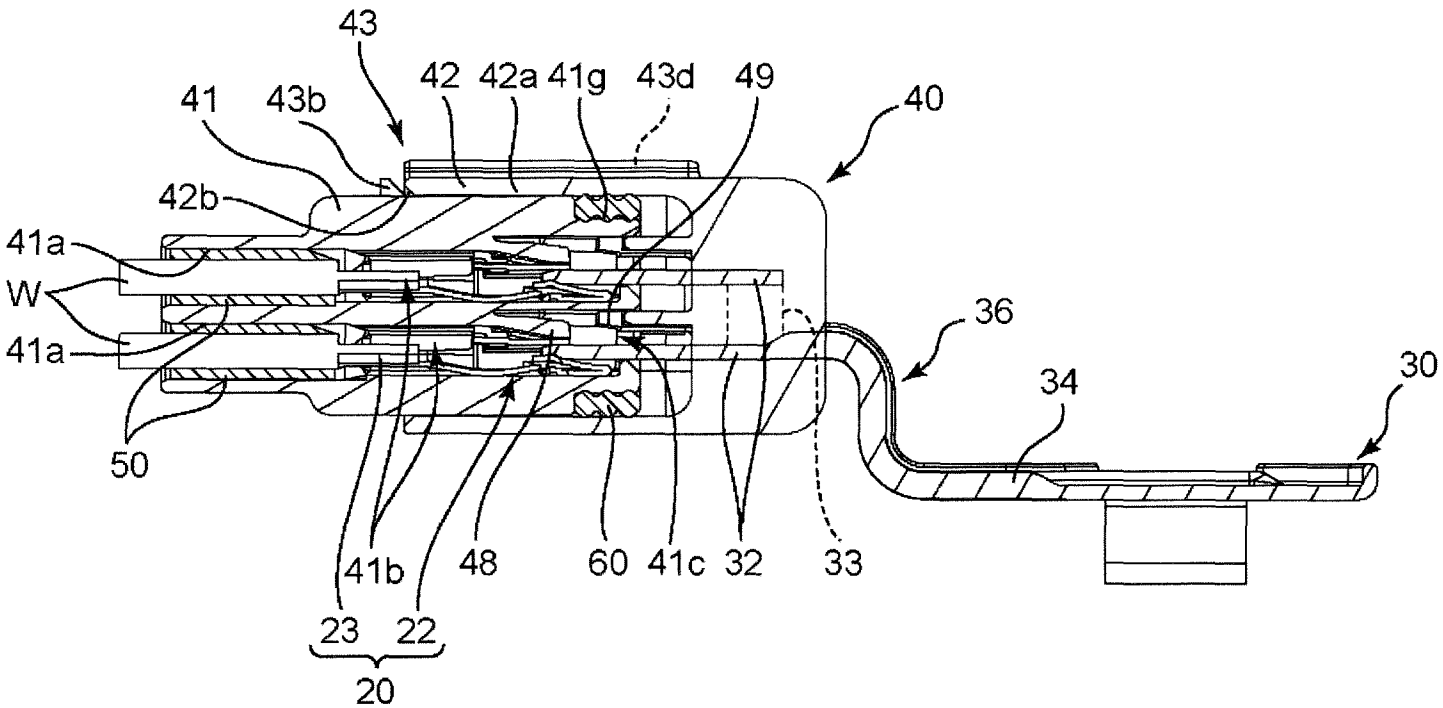
FIG. 8 is a section along VIII-VIII of FIG. 7.
Figure 9:
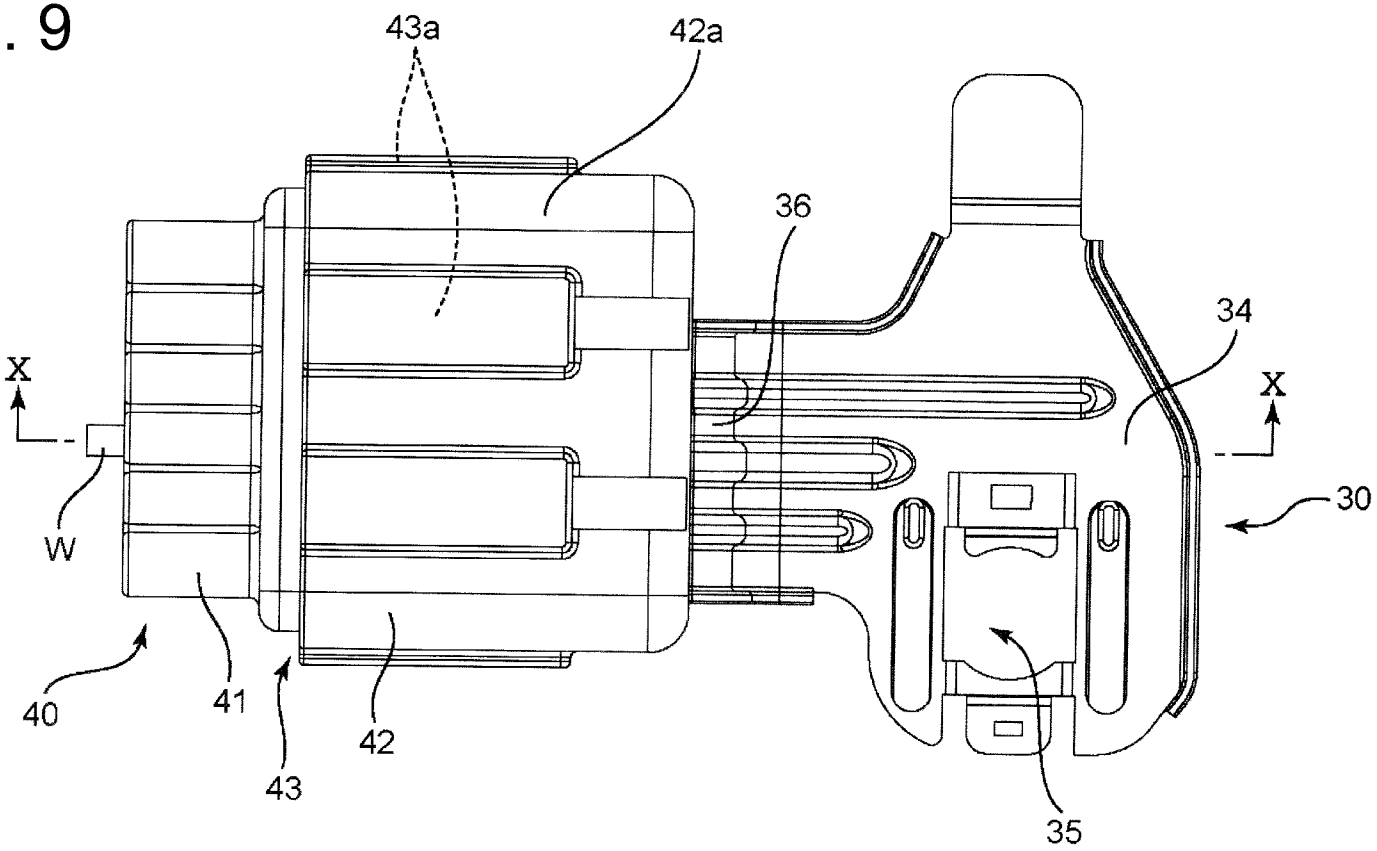
FIG. 9 is a plan view when the wire-side housing portion shown in FIG. 7 shifts from the first position to a second position to be fixed to a ground-side housing portion at the second position and the wire-side terminals of the ground wires are fully locked.

Further, in the temporarily held state shown in FIGS. 7 and 8, the wire-side housing portion 41 and the ground-side housing portion 42 are integrally coupled in the connector housing 40. This is preferable in terms of parts management. In addition, since projection-like parts such as the locking lances 48 are not exposed to the outside of the connector housing 40, a possibility of damage is reduced.

Further, in this embodiment, while the wire-side terminal 20 is being accommodated into the accommodating portion 41*b* of the wire-side housing portion 41, the locking lance 48 is displaced from the locking position where the wire-side terminal 20 is locked to the retracted position by the lance displacing portion 29. When the wire-side housing portion 41 is moved from the first position to the second position in that state, the locking lance 48 comes into contact with the lance locking portion 49 during the movement, thereby prohibiting the wire-side housing portion 41 from moving from the first position where the wire-side terminals 20 are temporarily held to the second position where the wire-side terminals 20 are fully locked. This can reliably prohibit a shift of the wire-side housing portion 41 from the first position to the second position in a state where the wire-side terminals 20 are not completely accommodated into the accommodating portion 41*b* of the wire-side housing portion 41.

Further, since the ground-side housing portion 42 is manufactured by insert molding in state where the terminal fitting portions 32 of the ground terminal 20 are projecting into the cover portion 42*a* in this embodiment, the ground-side housing portion 42 and the ground terminal 30 are held in close contact in a part of the ground-side housing portion 42 where the ground terminal 30 penetrates. Thus, sealability of the connector housing 40 can be further improved.

Further, in the assembling method of the ground joint connector of this embodiment, the locking lances 48 displaceable between the locking position where the wire-side terminal 20 is locked in the accommodating portion 41*b* and the retracted position which is retracted from the locking position and where the wire-side terminal 20 is insertable into and withdrawable from the accommodating portion 41*b* are not restricted at the locking position by the lance locking portions 49 in the temporary holding step with the wire-side housing portion 41 fixed to the ground-side housing portion 42 at the first position, whereby the wire-side terminals 20 are temporarily held. Thereafter, when the wire-side housing portion 41 is fixed to the ground-side housing portion 42 at the second position on the back side of the cover portion 42*a*, the locking lances 48 are restricted at the locking position by the lance locking portions 49 and the wire-side terminals 20 are locked in the accommodating portion 41*b* by being doubly locked by the locking lances 48 and the lance locking portions 49, thereby being fully locked. By this, whether or not the wire-side terminals 20 in the connector housing 40 are doubly locked can be easily confirmed from the outside by confirming from the outside whether or not the wire-side housing portion 41 is at the second position.

In addition, since the wire-side terminals 20 are doubly locked in the connector housing 40 by coupling the two housing portions 41, 42, a member such as a retainer for double locking is not exposed to the outside of the connector housing 40 and the waterproof plugs are held in close contact with the inner peripheral surfaces of the insertion holes of the wire-side housing portions 41. Thus, the waterproof function of the connector housing 40 can be maintained. This enables waterproofing and double locking to be simultaneously achieved.

Further, if the ground connection portion 34 is connected to the ground section after the waterproofing of the ground joint connector 1 and double locking are achieved by completing up to the full locking step of the assembling method of the above embodiment, a connection operation to the ground section can be easily and reliably performed.

Although the ground joint connector to be connected to the ground section of the vehicle is described as an example of the joint connector of the present invention in the above embodiment, the present invention is not limited to this and can be applied to joint connectors to be connected to other connection sections in a vehicle.

Note that the aforementioned specific embodiment mainly includes inventions having the following configurations.

A joint connector of the present invention is a joint connector for connecting a plurality of wires included in a harness to a connection section in a vehicle and includes a conductor including a connection-section-side connecting portion shaped to be connectable to the connection section and a plurality of terminal fitting portions, a plurality of wire-side terminals to be respectively connected to ends of the plurality of wires and fitted to the terminal fitting portions, a housing for holding the conductor and the wire-side terminals, waterproof plugs to be respectively mounted on the plurality of wires, and a seal member provided in the housing. The housing includes a wire-side housing portion for holding each wire-side terminal and a conductor-side housing portion for holding the conductor. The wire-side housing portion includes an accommodating portion into which each wire-side terminal is to be accommodated, movable pieces which are provided in the accommodating portion and displaceable between a locking position where the wire-side terminal is locked in the accommodating portion and a retracted position which is retracted from the locking position and where the wire-side terminal is insertable into and withdrawable from the accommodating portion, waterproof plug close-contact portions which communicate with the accommodating portion, into which the wire-side terminals are insertable and which are to be held in close contact with the waterproof plugs, and fitting portion insertion holes which communicate with the accommodating portion and into which the terminal fitting portions are insertable. The conductor-side housing portion includes a cover portion for holding the conductor such that the connection-section-side connecting portion is exposed and covering each terminal fitting portion of the conductor, and movable piece lock portions for restricting the movable pieces at the locking position. The cover portion includes an opening into which the wire-side housing portion is insertable. The conductor-side housing portion includes a fixing portion for fixing the wire-side housing portion inserted into the opening of the cover portion at a predetermined first position and a second position closer to a back side of the cover portion than the first position. The seal member is provided to seal a clearance between the inner peripheral surface of the cover portion of the conductor-side housing portion and the outer peripheral surface of the wire-side housing portion at least at the second position. The movable piece lock portions are provided at such positions as not to restrict the movable pieces at the locking position when the wire-side housing portion is fixed to the conductor-side housing portion at the first position and, on the other hand, restrict the movable pieces at the locking position when the wire-side housing portion is fixed to the conductor-side housing portion at the second position.

According to this configuration, the housing includes the conductor-side housing portion and the wire-side housing portion, and the wire-side terminals can be reliably temporarily held and fully locked by fixing the wire-side housing portion and the conductor-side housing portion at two positions.

Specifically, the movable pieces for locking the wire-side terminals are provided in the accommodating portion into which the wire-side terminals are to be accommodated. These movable pieces can be displaced between the locking position where the wire-side terminal is locked in the accommodating portion and the retracted position which is retracted from the locking position and where the wire-side terminal is insertable into and withdrawable from the accommodating portion. When the wire-side housing portion is fixed to the conductor-side housing portion at the first position by the fixing portion, the movable pieces are not restricted at the locking position by the movable piece lock portions and the wire-side terminals are temporarily held. On the other hand, when the wire-side housing portion is fixed to the conductor-side housing portion at the second position on the back side of the cover portion by the fixing portion, the movable pieces are restricted at the locking position by the movable piece lock portions and the wire-side terminals are restricted in the accommodating portion by being doubly locked by the movable pieces and the movable piece lock portions, thereby being fully locked. By this, whether or not the wire-side terminals in the housing are doubly locked can be easily confirmed by confirming from the outside whether or not the wire-side housing portion is at the second position.

In addition, since the wire-side terminals are doubly locked in the housing by coupling the two housing portions, a member such as a retainer for double locking is not exposed to the outside of the housing, the waterproof plugs are held in close contact with the waterproof plug close-contact portions communicating with the accommodating portion of the wire-side housing portion to seal the waterproof plug close contact portions, and the seal member seals the clearance between the inner peripheral surface of the cover portion of the conductor-side housing portion and the outer peripheral surface of the wire-side housing portion. Thus, the waterproof function of the housing can be maintained. This enables the waterproofing of the joint connector and double locking to be simultaneously achieved.

Further, preferably, the movable piece lock portions are provided at such positions as to restrict the movable pieces at the locking position by being located at sides of the movable pieces opposite to the wire-side terminals when the wire-side housing portion is fixed to the conductor-side housing portion at the second position, the wire-side terminal includes a movable piece displacing portion for displacing the movable piece from the locking position to the retracted position, and the movable piece displacing portion is provided at such a position as to be able to displace the movable piece to the retracted position and bring the movable piece into contact with the movable piece lock portion so that the movable piece prohibits a shift of the wire-side housing portion from the first position to the second position, while the wire-side terminal is being accommodated into the accommodating portion of the wire-side housing portion.

According to such a configuration, the movable piece is displaced from the locking position where the wire-side terminal is locked to the retracted position by the movable piece displacing portion while the wire-side terminal is being accommodated into the accommodating portion of the wire-side housing portion. When the wire-side housing portion is moved from the first position to the second position in that state, the movable piece comes into contact with the movable piece lock portion during the movement, thereby prohibiting the shift of the wire-side housing portion from the first position where the wire-side terminals are temporarily held to the second position where the wire-side terminals are fully locked. This can reliably prohibit the shift of the wire-side housing portion from the first position to the second position in a state where the wire-side terminals are not completely accommodated into the wire-side housing portion.

Further, the conductor-side housing portion is preferably insert-molded in a state where the terminal fitting portions of the conductor are projecting into the cover portion.

According to such a configuration, since the conductor-side housing portion is manufactured by insert molding in the state where the terminal fitting portions of the conductor are projecting into the cover portion, the conductor-side housing portion and the conductor are held in close contact in a part of the conductor-side housing portion where the conductor penetrates. Thus, sealability of the housing can be further improved.

An assembling method of a joint connector of a wiring harness of the present invention is an assembling method of the above joint connector and includes a preparation step of preparing the housing, the wire-side terminals and the waterproof plugs of the joint connector, a temporary holding step of inserting the wire-side terminals through the waterproof plug close contact portions to be accommodated into the accommodating portion, bringing the waterproof plugs into close contact with the waterproof plug close contact portions and locking the wire-side terminals in the accommodating portion by the movable pieces with the wire-side housing portion fixed to the conductor-side housing portion at the first position, and a full locking step of fixing the wire-side housing portion to the conductor-side housing portion at the second position by the coupling portion and sealing a clearance between the wire-side housing portion and the conductor-side housing portion by the seal member by moving the wire-side housing portion toward the back of the cover portion and, in that stat, restricting the movable pieces at a position for locking the wire-side terminal by the movable piece lock portions, thereby restricting the wire-side terminals in the accommodating portion.

According to these characteristics, in the temporary holding step, the movable pieces displaceable between the locking position where the wire-side terminal is locked in the accommodating portion and the retracted position which is retracted from the locking position and where the wire-side terminal is insertable into and withdrawable from the accommodating portion are not restricted at the locking position by the movable piece lock portions with the wire-side housing portion fixed to the conductor-side housing portion at the first position, whereby the wire-side terminals are temporarily held. Thereafter, when the wire-side housing portion is fixed to the conductor-side housing portion at the second position on the back side of the cover portion, the movable pieces are restricted at the locking position by the movable piece lock portions and the wire-side terminals are restricted in the accommodating portion by being doubly locked by the movable pieces and the movable piece lock portions, thereby being fully locked. By this, whether or not the wire-side terminals in the housing are doubly locked can be easily confirmed by confirming from the outside whether or not the wire-side housing portion is at the second position.

In addition, since the wire-side terminals are doubly locked in the housing by coupling the two housing portions, a member such as a retainer for double locking is not exposed to the outside of the housing, the waterproof plugs are held in close contact with the waterproof plug close-contact portions communicating with the accommodating portion of the wire-side housing portion to seal the waterproof plug close contact portions, and the seal member seals the clearance between the conductor-side housing portion and the wire-side housing portion. Thus, the waterproof function of the housing can be maintained. This enables the waterproofing of the joint connector and double locking to be simultaneously achieved.

Further, it is preferable to further include a connection step of connecting the connection-section-side connecting portion to the connection section after the full locking step.

According to such a configuration, the connection-section-side connecting portion can be connected to the connection section after the waterproofing of the joint connector and double locking are achieved, and a connection operation to the connection section can be easily and reliably performed.

The invention claimed is:

1. A joint connector for connecting a plurality of wires included in a harness to a connection section in a vehicle, comprising:

a conductor including a connection-section-side connecting portion shaped to be connectable to the connection section and a plurality of terminal fitting portions;

a plurality of wire-side terminals to be respectively connected to ends of the plurality of wires and fitted to the terminal fitting portions;

a housing for holding the conductor and the wire-side terminals;

waterproof plugs to be respectively mounted on the plurality of wires; and a seal member provided in the housing;

wherein:

the housing includes a wire-side housing portion for holding each wire-side terminal and a conductor-side housing portion for holding the conductor;

the wire-side housing portion includes an accommodating portion into which each wire-side terminal is to be accommodated, movable pieces which are provided in the accommodating portion and displaceable between a locking position where the wire-side terminal is locked in the accommodating portion and a retracted position which is retracted from the locking position and where the wire-side terminal is insertable into and withdrawable from the accommodating portion, waterproof plug close-contact portions which communicate with the accommodating portion, into which the wire-side terminals are insertable and which are to be held in close contact with the waterproof plugs, and fitting portion insertion holes which communicate with the accommodating portion and into which the terminal fitting portions are insertable;

the conductor-side housing portion includes a cover portion for holding the conductor such that the connection-section-side connecting portion is exposed and covering each terminal fitting portion of the conductor, and movable piece lock portions for restricting the movable pieces at the locking position;

the cover portion includes an opening into which the wire-side housing portion is insertable;

the conductor-side housing portion includes a fixing portion for fixing the wire-side housing portion inserted into the opening of the cover portion at a predetermined first position and a second position closer to a back side of the cover portion than the first position;

the seal member is provided to seal a clearance between the inner peripheral surface of the cover portion of the conductor-side housing portion and the outer peripheral surface of the wire-side housing portion at least at the second position; and the movable piece lock portions are provided at such positions as not to restrict the movable pieces at the locking position when the wire-side housing portion is fixed to the conductor-side housing portion at the first position and, on the other hand, restrict the movable pieces at the locking position when the wire-side housing portion is fixed to the conductor-side housing portion at the second position.

2. A joint connector according to claim 1, wherein:

the movable piece lock portions are provided at such positions as to restrict the movable pieces at the locking position by being located at sides of the movable pieces opposite to the wire-side terminals when the wire-side housing portion is fixed to the conductor-side housing portion at the second position;

the wire-side terminal includes a movable piece displacing portion for displacing the movable piece from the locking position to the retracted position; and the movable piece displacing portion is provided at such a position as to be able to displace the movable piece to the retracted position and bring the movable piece into contact with the movable piece lock portion so that the movable piece prohibits a shift of the wire-side housing portion from the first position to the second position, while the wire-side terminal is being accommodated into the accommodating portion of the wire-side housing portion.

3. A joint connector according to claim 1, wherein the conductor-side housing portion is insert-molded in a state where the terminal fitting portions of the conductor are projecting into the cover portion.

4. An assembling method of a joint connector according to the claim 1, comprising:

a preparation step of preparing the housing, the wire-side terminals and the waterproof plugs of the joint connector;

a temporary holding step of inserting the wire-side terminals through the waterproof plug close contact portions to be accommodated into the accommodating portion, bringing the waterproof plugs into close contact with the waterproof plug close contact portions and locking the wire-side terminals in the accommodating portion by the movable pieces with the wire-side housing portion fixed to the conductor-side housing portion at the first position; and a full locking step of fixing the wire-side housing portion to the conductor-side housing portion at the second position by the coupling portion and sealing a clearance between the wire-side housing portion and the conductor-side housing portion by the seal member by moving the wire-side housing portion toward the back of the cover portion and, in that stat, restricting the movable pieces at a position for locking the wire-side terminal by the movable piece lock portions, thereby restricting the wire-side terminals in the accommodating portion.

5. An assembling method according to claim 4, further comprising a connection step of connecting the connection-section-side connecting portion to the connection section after the full locking step.

* * * * *